US009872098B2

(12) United States Patent
Tanoue et al.

(10) Patent No.: US 9,872,098 B2
(45) Date of Patent: Jan. 16, 2018

(54) WIRING STRUCTURE FOR ELECTROACOUSTIC TRANSDUCER FOR DIGITAL SIGNAL AND HEADPHONE FOR DIGITAL SIGNAL

(71) Applicants: Koichiro Tanoue, Tokyo (JP); Kenzo Tsuihiji, Tokyo (JP); Yoji Honda, Tokyo (JP); Kenji Arai, Tokyo (JP)

(72) Inventors: Koichiro Tanoue, Tokyo (JP); Kenzo Tsuihiji, Tokyo (JP); Yoji Honda, Tokyo (JP); Kenji Arai, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/937,943

(22) Filed: Nov. 11, 2015

(65) Prior Publication Data

US 2016/0142809 A1 May 19, 2016

(30) Foreign Application Priority Data

Nov. 18, 2014 (JP) ..... 2014-233916

(51) Int. Cl.

| | |
|---|---|
| ***H04R 25/00*** | (2006.01) |
| ***H04R 1/10*** | (2006.01) |
| ***H04R 5/033*** | (2006.01) |
| *H04R 1/00* | (2006.01) |
| *H04R 9/06* | (2006.01) |

(52) U.S. Cl.

CPC ..... *H04R 1/1033* (2013.01); *H04R 1/1008* (2013.01); *H04R 5/0335* (2013.01); *H04R 1/005* (2013.01); *H04R 1/1066* (2013.01); *H04R 9/063* (2013.01); *H04R 2201/103* (2013.01); *H04R 2209/022* (2013.01)

(58) Field of Classification Search

CPC .. H04R 1/1086; H04R 1/1008; H04R 1/1016; H04R 1/1033; H04R 1/1058; H04R 5/033; H04R 5/0335; H04R 9/04; H04R 2209/022; H04R 1/005; H04R 9/063; H04R 2201/103

USPC ..... 381/309, 74, 370, 374, 380, 381, 384, 381/189, 400, 401; 174/102 R, 110 R, 174/113 R, 120 R, 121 R, 27, 34, 36; 379/430, 438

See application file for complete search history.

(56) References Cited

U.S. PATENT DOCUMENTS 1,521,275 A * 12/1924 Carpenter ..... H04R 1/1033 123/633
1,606,165 A * 11/1926 Glenn ..... H01B 7/04 123/633
5,459,284 A * 10/1995 Bockelman ..... H01L 24/49 174/27

(Continued)

FOREIGN PATENT DOCUMENTS

JP 4883428 2/2012

*Primary Examiner* — Huyen D Le
(74) *Attorney, Agent, or Firm* — Whitham, Curtis & Cook, P.C.

(57) ABSTRACT

A wiring structure is provided for an electroacoustic transducer directly converting digital signals from a single sound source to sound waves without conversion to analog signals. The structure includes a diaphragm, and a plurality of voice coils fixed to the diaphragm. The voice coils are connected to respective cables each consisting of a stranded pair of positive and negative input lines.

4 Claims, 5 Drawing Sheets

(56) References Cited

U.S. PATENT DOCUMENTS

| | | | | |
|---|---|---|---|---|
| 7,449,631 | B2 * | 11/2008 | Lee | H01B 11/1817 174/102 R |
| 2009/0110217 | A1 | 4/2009 | Yasuda et al. | |
| 2009/0255706 | A1 * | 10/2009 | Jiang | H01B 1/24 174/102 R |
| 2011/0051974 | A1 * | 3/2011 | Liu | B82Y 30/00 381/370 |
| 2012/0076342 | A1 * | 3/2012 | Weber | D07B 1/16 381/384 |
| 2013/0156231 | A1 | 6/2013 | Yasuda et al. | |
| 2014/0056466 | A1 * | 2/2014 | Jenq | H04R 1/403 381/401 |

* cited by examiner

WIRING STRUCTURE FOR ELECTROACOUSTIC TRANSDUCER FOR DIGITAL SIGNAL AND HEADPHONE FOR DIGITAL SIGNAL

TECHNICAL FIELD

The present invention relates to a wiring structure for an electroacoustic transducer and a headphone.

BACKGROUND ART

A traditional electroacoustic transducer for use in an audio speaker or a headphone assembly includes a diaphragm vibrating in response to the magnitude and frequency of input analogue signals for generating sound waves. Digital signals from a sound source should be converted into analogue signals before input to the traditional electroacoustic transducer.

A signal converter has been developed that enables an electroacoustic transducer to receive digital signals from a sound source without conversion of the digital signals into analogue signals and drive a diaphragm vibrating in response to the compression or density of digital signals for generating sound waves (See for example PTL 1: Japanese Patent No. 4,883,428).

A headphone assembly including the signal converters disclosed in PTL 1 in a right ear piece and a left ear piece can processes digital signals in all the circuit components from the sound source to the drive units of the electroacoustic transducers.

A traditional headphone assembly includes a first electroacoustic transducer and a second electroacoustic transducer in paired right and left ear pieces, respectively. The first electroacoustic transducer receives signals from a sound source and the second electroacoustic transducer receives signals from the sound source via signal lines disposed between the first and second transducers. The signal lines between the transducers are referred to as a connecting cable. The connecting cable is generally disposed inside or along a head band.

Digital signals, which have been affected by extraneous noise during transmission via signal lines, are generally corrected at the receiver. Digital signals are thus barely affected by extraneous noise. Extraneous noise is derived from extraneous electromagnetic waves reaching the signal lines.

The connecting cable is disposed inside or along a head band. The connecting cable disposed above a user's head is readily affected by extraneous electromagnetic waves or extraneous noise as described above.

In the above-mentioned headphone assembly including these two electroacoustic transducers with the signal converters disclosed in PTL 1, digital signals are transmitted from one of the electroacoustic transducers to the other electroacoustic transducer via the connecting cable. The digital signals are directly input to the other electroacoustic transducer without correction and drive the diaphragm.

The received uncorrected digital signals include extraneous noise, which has invaded through the connecting cable. The signals affected by the extraneous noise, which has invaded during transmission, drive the diaphragm. The generated sound waves are thus affected by the extraneous noise. Although digital signals generally have high noise resistance, digital signals affected by extraneous noise and uncorrected at the receiver may fail to produce high-quality sound.

In the field of electroacoustic transducers, there have been disclosed the solutions to the problems of how to prevent extraneous noise invasion or how to eliminate the effects of extraneous noise. Such traditional solutions however cannot be applied to a novel driving scheme that directly drives a diaphragm with digital signals.

To prevent extraneous noise invasion or to eliminate the effects of extraneous noise in the novel driving scheme, digital input signals should be converted into digital driving signals immediately before application to a diaphragm. Thus, the signal converter is disposed in the immediate vicinity to each of the left and right diaphragm.

This complicates the structure and increases the manufacturing cost. In a headphone assembly based on the novel driving scheme, it is desirable to dispose a single signal converter adjacent to only one of the right and left diaphragms and transmit digital driving signals along a head band.

If the first electroacoustic transducer receives digital signals not affected by noise and the second electroacoustic transducer receives digital signals affected by noise, a difference in sensitivity and/or sound quality occurs between the paired right and left electroacoustic transducers.

Moreover, since digital signals include large amounts of high-frequency components, they may emit large amounts of undesirable radiation waves.

SUMMARY OF INVENTION

Technical Problem

An object of the present invention is to provide a wiring structure for an electroacoustic transducer and an electroacoustic transducer including the wiring structure. The wiring structure prevents extraneous noise from invading into the connecting cable between the paired right and left electroacoustic transducers and helps generate high-quality sound waves.

Solution to Problem

The present invention includes a diaphragm, and a plurality of voice coils fixed to the diaphragm. The voice coils are connected to respective cables each consisting of a stranded pair of positive and negative input lines.

Advantageous Effects of Invention

The present invention can prevent extraneous noise from invading into the connecting cables between the paired right and left electroacoustic transducers that drive the diaphragm s in response to digital signals, and generate high-quality sound waves.

DESCRIPTION OF EMBODIMENTS

With reference to the drawings, embodiments of the wiring structure and electroacoustic transducer of the present invention will now be described.

Electroacoustic Transducer

Figure 1:
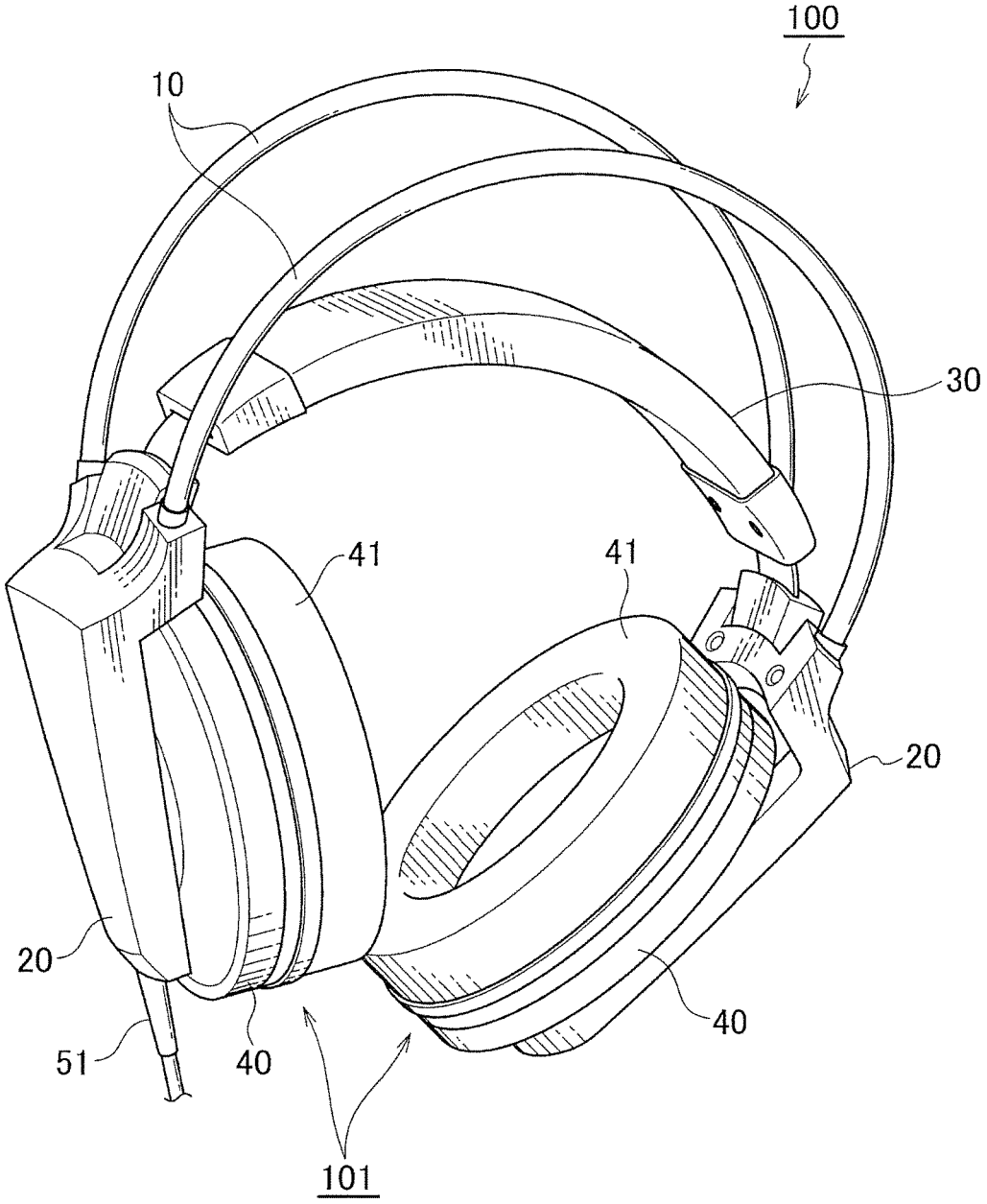
FIG. 1 is a perspective view of an electroacoustic transducer of the present invention.

An embodiment of the electroacoustic transducer will be described. As shown in FIG. 1, a headphone assembly 100 includes a pair of right and left ear pieces or headphone units 101, each having an electroacoustic transducer. The headphone units 101 are held by supports 20 connected to two ends of a head pad 30. Each headphone unit 101 includes an ear pad 41 to be worn by a user on his ear, and a housing 40 on which the ear pad 41 is mounted. The contact face of the ear pad 41 is substantially oval so as to cover a use's ear. The housing 40 is also substantially oval conforming to the ear pad 41. The housing 40 and the ear pad 41 may have any shape other than the substantially oval shape. For example, the shape may be a substantially circular shape, which has been traditionally employed, or a polygonal shape.

The housing 40 accommodates an electroacoustic transducing mechanism converting electric signals into sound waves. The electroacoustic transducing mechanism includes voice coils receiving input digital signals, and a diaphragm vibrating in response to the digital signals applied to the voice coils for generating sound waves. The electroacoustic transducing mechanism also includes a magnetic circuit having a magnetic gap. The voice coils are disposed in the magnetic gap. The support 20 holding the housing 40 is disposed on the outer surface of the housing 40 and is longitudinally coupled with the head pad 30. The support 20 has an elongated shape tapering toward the tip end.

Digital signals from a sound source 50 described below undergo predetermined modulation (signal conversion) before application to the voice coils. Therefore, digital signals applied to the diaphragm in the electroacoustic transducing mechanism are of a different modulation form from that of digital signals from the sound source 50. For example, digital signals from the sound source 50 may be pulse code modulation (PCM) signals and digital signals applied to the diaphragm may be pulse density modulation (PDM) signals. The same principle is applied to the digital signals applied to the diaphragm described below.

Digital signals to be applied to the voice coils are generated from a single digital signal from the sound source 50. The digital signals have different signal sequences (digital signal patterns).

A plurality of voice coils are fixed to the diaphragm. Digital signals applied to these voice coils have different signal sequences. One of the generated signals are applied to one voice coil of the diaphragm and another generated signal having a different signal sequence of the generated signals are applied to another voice coil of the diaphragm.

Figure 4:
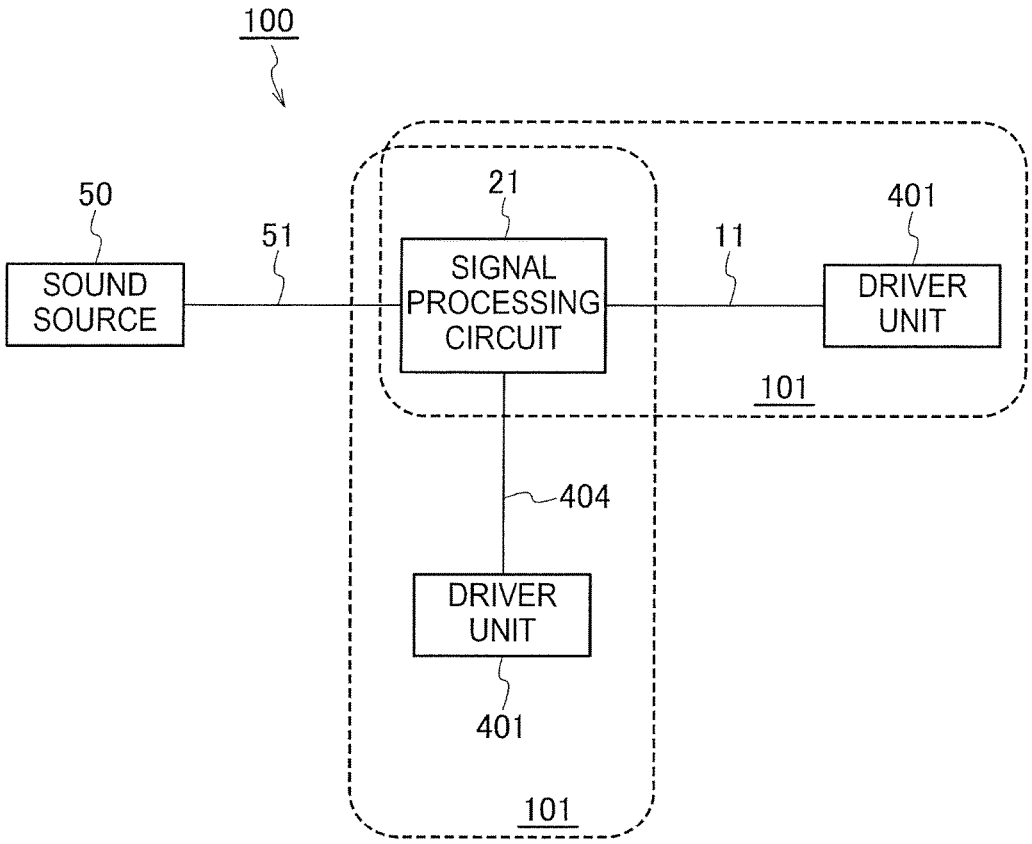
FIG. 4 is a block diagram illustrating a function of the example structure for the above electroacoustic transducer.

The support 20 has an inner space to accommodate a signal processing circuit 21 described below (See FIG. 4). Only one of the supports 20 holding the paired right and left housings 40 accommodates the signal processing circuit 21. The lower end of the support 20 accommodating the signal processing circuit 21 includes an interface connecting to first signal lines (a connecting cable 51) receiving input signals from the sound source.

The right and left supports 20 respectively holding the right and left housings 40 are connected to each other with a head pad 30. The right and left supports 20 are also connected to each other with resilient curved bars 10. One of the curved bars 10 is connected to the upper forward portions of the supports 20 at its ends. The other curved bar 10 is connected to the upper rearward portions of the supports 20 at its ends. The curved bars 10 generate lateral force during use of the headphone assembly 100. The curved bars 10 then serve as a head band. In the present embodiment, each curved bar 10 accommodates second signal lines described below. Instead of the curved bars 10, the head pad 30 may have resilience so as to generate lateral force. The head pad 30 then serves as a head band.

The structure of each headphone unit 101 of the headphone assembly 100 will be described. As shown in FIG. 4, the headphone unit 101 includes the signal processing circuit 21 and a drive unit 401. The drive unit 401 is an electroacoustic transducing mechanism converting digital signals from the signal processing circuit 21 directly into sound waves for generating sound.

The drive unit 401 includes a magnetic circuit having a magnetic gap, a plurality of voice coils disposed in the magnetic gap, and a diaphragm vibrating in response to electric signals applied to the voice coil. The vibration of the diaphragm converts electric signals into sound waves. The signals applied to the drive unit 401 may be PDM digital signals, as described above. A traditional electroacoustic transducing mechanism converts digital signals into analogue signals and applies the analogue signals to voice coils for generating sound. In contrast, the electroacoustic transducing mechanism of the present embodiment directly uses digital signals for generating sound. As described above, each drive unit 401 has a plurality of voice coils for a single diaphragm.

The signal processing circuit 21 is connected to the digital sound source 50 via the first signal lines or the connecting cable 51.

There are two drive units 401 and 401'. One of the drive units is defined as "the first drive unit 401" and the other drive unit is defined as "the second drive unit 401'." The first drive unit 401 adjacent to the signal processing circuit 21 is electrically connected to the signal processing circuit 21 via a signal cable 404. The second drive unit 401' remote from the signal processing circuit 21 is electrically connected to the signal processing circuit 21 via second signal lines or connecting cables 11.

Each drive unit 401 and 401' includes four voice coils, for example, and the four voice coils are mounted on a single diaphragm. Each voice coil receives the processed digital signals from the signal processing circuit 21. Two signal lines are required for connecting the signal processing circuit 21 to one of the voice coils. One of the signal lines is a positive input line and the other is a negative input line. A pair of the positive and negative input lines constitutes the signal cable 404 and the connecting cable 11 for a single voice coil.

Wiring Structure

Figure 2:
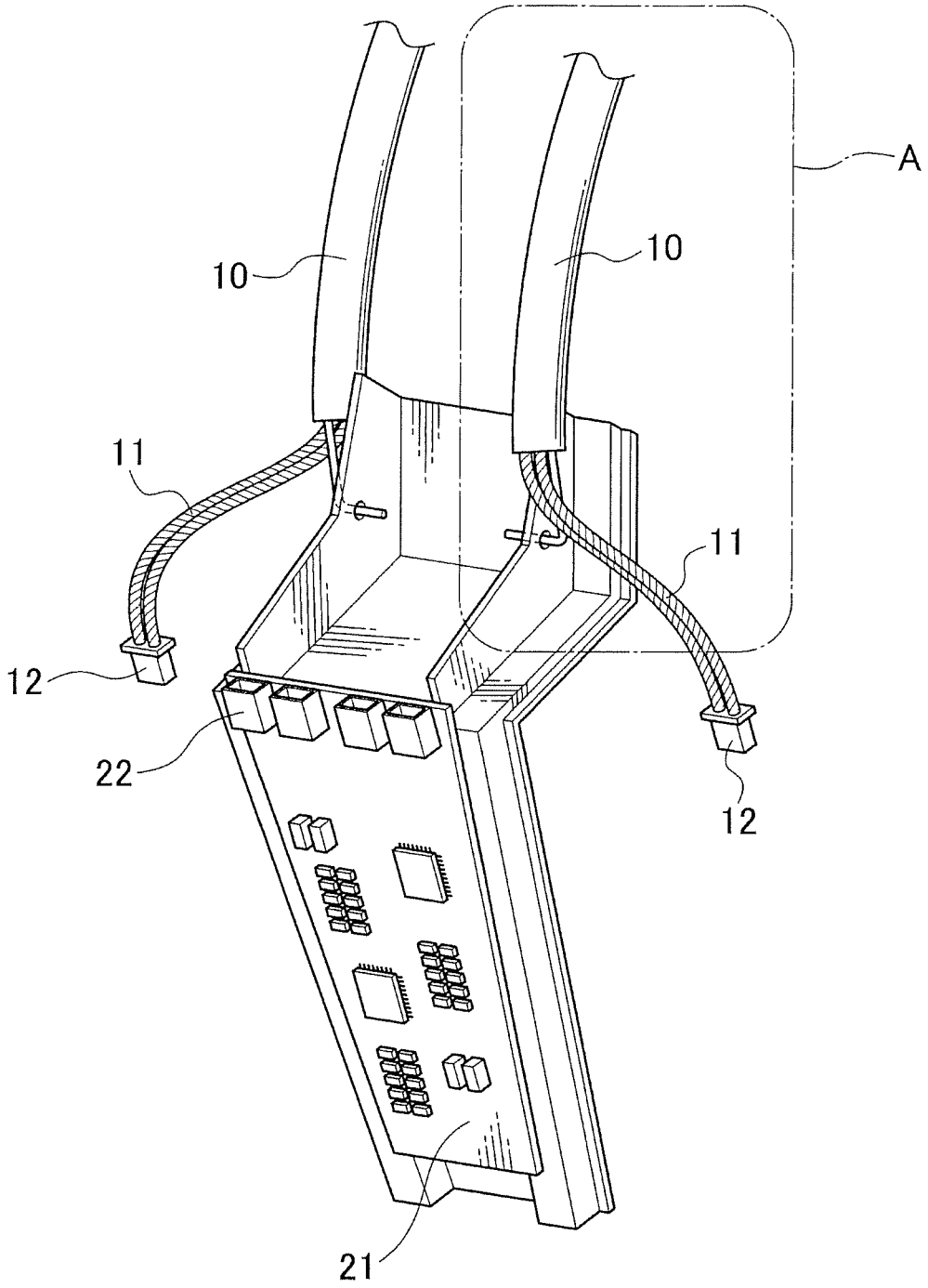
FIG. 2 is a partial enlarged exploded view of the above electroacoustic transducer.

The wiring structure of the present invention will now be described. FIG. 2 is an enlarged exploded view illustrating an example headphone unit 101 without the outer cover of the support 20 and the housing 40. As shown in FIG. 2, the support 20 accommodates the signal processing circuit 21. The signal processing circuit 21 includes a signal converter, a memory storing a signal converting program, and an output terminal or a cable socket 22 for the digital signals converted by the signal converter. The signal processing circuit 21 tapers toward the bottom, like the support 20. Alternatively, the signal processing circuit 21 may have any other shape.

The signal converter and the signal converting program perform predetermined signal conversion, such as conversion into PDM digital signals, on the digital signals from the sound source 50. The digital signals converted by the signal converter and the signal converting program are transmitted from the signal processing circuit 21 to the second drive unit 401' via the connecting cables 11 connected to the cable socket 22. The transmitted digital signals are applied to each of the voice coils in the second drive unit 401'.

Each connecting cable 11 consists of a stranded pair of positive and negative input lines. As described above, the drive unit 401 or 401' includes four voice coils, which need four connecting cables 11 each consisting of a stranded pair of lines. As shown in FIG. 2, a cable plug 12 attached to ends of two connecting cables 11, for example, is connected to one of the cable sockets 22. The other ends of the connecting cables 11 are connected to the leading lines of a voice coil. This connects the second drive unit 401' to the signal processing circuit 21 adjacent the first drive unit 401.

Figure 3:
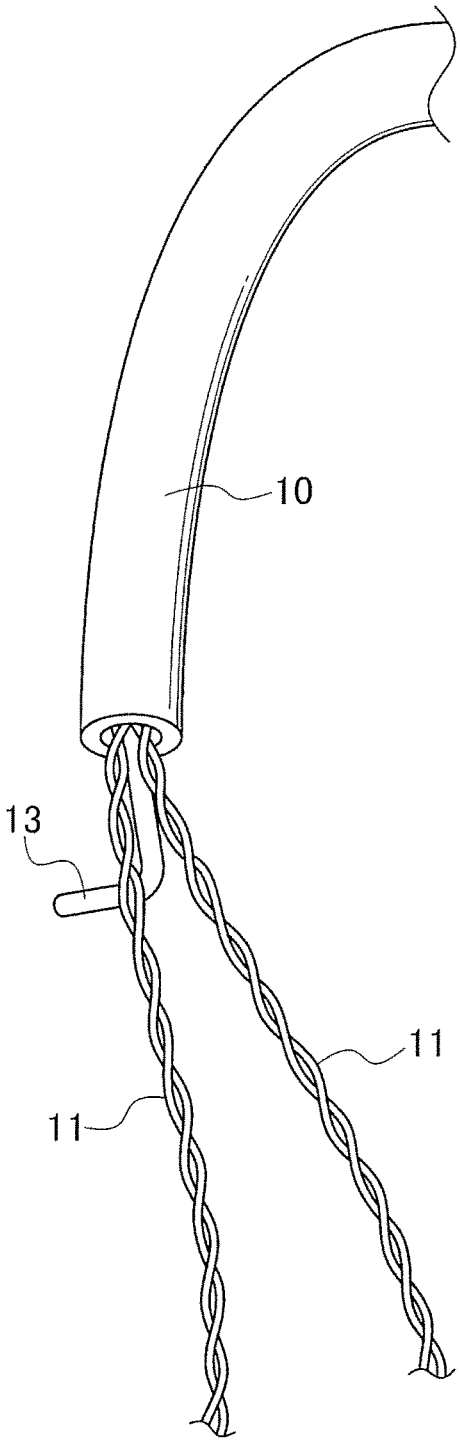
FIG. 3 is a partial enlarged view of an end portion of an example wiring structure for the above electroacoustic transducer.

FIG. 3 is a partial enlarged view illustrating the area A shown in FIG. 2. As shown in FIG. 3, the curved bar 10 accommodates two connecting cables 11 and a rod spring 13. The number of the accommodated connecting cables 11 depends on the diameter of the curved bar 10. The curved bar 10 with a larger diameter can accommodate, for example, four connecting cables 11. The connecting cables 11 may be disposed in the head pad 30.

The end portion of the rod spring 13 is bent into an L shape in the radial direction of the curved bar 10. The L-shaped end portion is engaged with the upper end of the support 20 such that the curved bar 10 is mounted on the support 20.

Advantageous Effect of Wiring Structure

Signals transmitted from the signal processing circuit 21 to the drive unit 401 are modulated digital signals for directly driving the diaphragm. In a traditional headphone unit, digital signals, which have been affected by noise during transmission, are converted to analogue signals and corrected to eliminate the effects of noise before application to the diaphragm. In contrast, the headphone unit 101 of the present embodiment directly applies digital signals to the diaphragm. In the headphone unit 101, a series of rectangular waves constituting digital signals is applied to the diaphragm to vibrate the diaphragm. If extraneous noise invades digital signals during transmission, the digital signals affected by the extraneous noise are applied to the diaphragm without correction. The extraneous noise changes the pattern of the digital signals to be applied to the diaphragm. The digital signals having a pattern different from the original one are applied to the diaphragm. This interferes with the normal output of sound waves based on the signals from the sound source 50 and degrades the quality of the output sound.

The wiring structure of the above-mentioned connecting cable 11 consisting of the stranded pair of positive and negative input lines eliminates the above-mentioned effects of extraneous noise. Digital signals in the positive input line have the opposite polarity to digital signals in the negative input line. The stranded pair of positive and negative input lines improve the inter-line coupling. This improves the resistance to extraneous noise and reduces the effects of noise on the input digital signals for a specific voice coil or specific voice coils.

The improvement in the coupling in the stranded pair of positive and negative input lines prevents undesirable radiation waves from the connecting cable 11 for supplying the digital signals including large amounts of high-frequency components.

As described above, the electroacoustic transducer including the wiring structure eliminating the effects of extraneous noise maintains high sound quality or sensitivity in the full digital scheme that outputs signals from the digital sound source without conversion, and produces high-quality sound only the digital sound source.

Electromagnetic Shielding Structure of Wiring Structure

Figure 5:
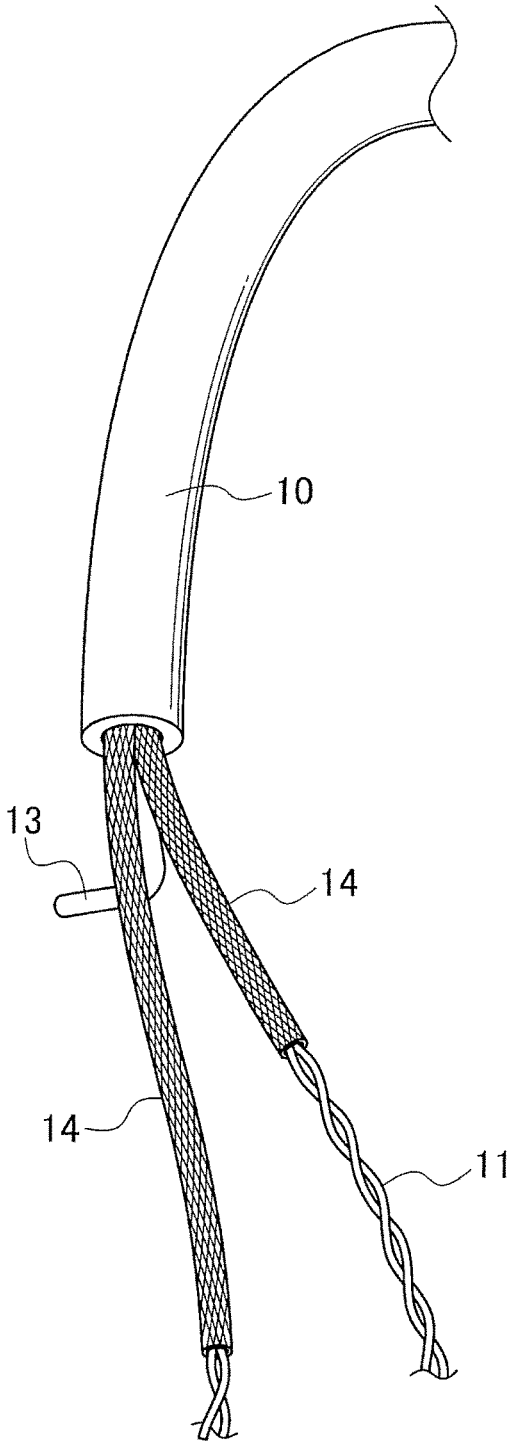
FIG. 5 is a partial enlarged view of an end portion of another example wiring structure for the above electroacoustic transducer.

As shown in FIG. 5, the connecting cable 11 or stranded pair of lines may be covered with an electromagnetic shield 14 to have an electromagnetic shielding structure. Alternatively, two or four stranded pairs of lines to be attached to a cable socket 22 may be covered with a single electromagnetic shield 14 to provide an electromagnetic shielding structure. In another embodiment, the curved bar 10 may have an electromagnetic shielding structure. Whichever electromagnetic shielding structure is connected to the ground voltage, and the connecting point to the ground voltage is preferably disposed closer to the signal processing circuit 21.

The electromagnetic shield 14 may be a net member that can block electromagnetic waves. Alternatively, the electromagnetic shield may be a conductive tube.

As described above, the electromagnetic shield structure covering the connecting cable 11 improves the resistance to extraneous noise. The above-mentioned electromagnetic shielding structure also impedes undesirable radiation of electromagnetic waves. The paired right and left electroacoustic transducers including the connecting cables with the above-mentioned electromagnetic shielding structure impede invasion of extraneous noise into the connecting cables and generate high-quality sound waves.

The invention claimed is:

1. A headphone for digital signal assembly comprising:

a pair of right and left ear pieces, each ear piece comprising a housing including an electroacoustic transducer having a diaphragm and a plurality of voice coils fixed to the diaphragm;

only one signal processing circuit, wherein the only one signal processing circuit is in only one of the right and left ear pieces;

a longitudinally curved head band having the right and left ear pieces at its ends; and cables respectively connected to the voice coils, wherein the respective cables consist of a positive input line and a negative input line, wherein each positive input line and each negative input line connected to a same voice coil form a stranded pair, wherein the cables are disposed inside or along the head band, and wherein the cables are configured to transmit digital signals i) from the only one signal processing circuit in one ear piece ii) to the electroacoustic transducer in the other ear piece.

2. The headphone assembly according to claim 1, wherein the cables each have an electromagnetic shielding structure covering the pair of positive and negative input signal lines.

3. The headphone assembly according to claim 1, wherein the cables each have an electromagnetic shielding structure separately covering the positive input line and the negative input line of each cable.

4. The headphone assembly according to claim 1, wherein all cables connected to the voice coil consists of a stranded pair of positive and negative input lines.

* * * * *